US006133682A

United States Patent [19]

Murai et al.

[11] Patent Number: 6,133,682

[45] Date of Patent: Oct. 17, 2000

[54] COLOR CATHODE RAY TUBE HAVING SHADOW MASK WITH PRESCRIBED BRIDGE WIDTHS

[75] Inventors: Takashi Murai; Ichiro Saotome; Munechika Tani, all of Saitama-ken, Japan

[73] Assignee: Kabushiki Kaisha Toshiba, Kawasaki, Japan

[21] Appl. No.: 09/125,395

[22] PCT Filed: Dec. 18, 1997

[86] PCT No.: PCT/JP97/04687

§ 371 Date: Aug. 18, 1998

§ 102(e) Date: Aug. 18, 1998

[87] PCT Pub. No.: WO98/27573

PCT Pub. Date: Jun. 25, 1998

[30] Foreign Application Priority Data

Dec. 18, 1996 [JP] Japan ..... 8-338055

[51] Int. Cl.[7] ..... H01J 29/07

[52] U.S. Cl. ..... 313/403

[58] Field of Search ..... 313/403, 408, 313/402

[56] References Cited

U.S. PATENT DOCUMENTS 3,652,895 3/1972 Tsuneta et al. ..... 313/403
4,159,177 6/1979 Elshof et al. ..... 355/133
5,055,736 10/1991 Yun et al. ..... 313/402
5,243,253 9/1993 Marks et al. ..... 313/403

FOREIGN PATENT DOCUMENTS 8-148093 6/1996 Japan ..... H01J 29/07

OTHER PUBLICATIONS

Patent Abstracts of Japan vol. 006, No. 173 (E–129), Sep. 7, 1982.

*Primary Examiner*—Michael H. Day
*Attorney, Agent, or Firm*—Pillsbury Madison & Sutro Intellectual Property Group

[57] ABSTRACT

A shadow mask opposed to a phosphor screen has a substantially rectangular effective surface (30) where slit-like apertures are formed. The apertures are disposed so as to constitute a plurality of aperture rows which extend in parallel with the short axis of the effective surface and are disposed in the long axis of the effective surface. Each of the aperture rows includes a plurality of aperture, and bridges (38) positioned between any adjacent pair of the apertures. The width B of the bridges in the lengthwise direction of the aperture rows, positioned an intermediate between the short axis of the effective surface and a short side edge thereof is greater than that of the bridges positioned at a peripheral portion of the effective surface.

6 Claims, 3 Drawing Sheets

COLOR CATHODE RAY TUBE HAVING SHADOW MASK WITH PRESCRIBED BRIDGE WIDTHS

TECHNICAL FIELD

The present invention relates to a color cathode ray tube and particularly to a color cathode ray tube comprising a shadow mask having a number of apertures.

BACKGROUND ART

In general, a color cathode ray tube comprises a vacuum envelope having a face panel, a phosphor screen formed on an inner surface of the face panel and including three color phosphor layers capable of radiating in blue, green, and red, a shadow mask opposed to the phosphor screen, and an electron gun provided in a neck of the vacuum envelope. The shadow mask includes a mask body having a number of apertures for passing electron beams, and a mask frame supporting the peripheral edge portion of the mask body. In this color cathode ray tube, three electron beams emitted from the electron gun scan the phosphor screen through the shadow mask, thereby displaying a color image.

The shadow mask is provided to select the three electron beams to be respectively landed on predetermined positions on the three color phosphor layers, and this selection must be correctly carried out such that three electron beams are respectively landed correctly on predetermined positions of the three color phosphor layers, in order that a color image displayed on the phosphor screen obtains an excellent color purity. Therefore, the shadow mask must be arranged so that a predetermined positional relationship is always maintained with respect to the phosphor screen during operation of the color cathode ray tube, i.e., the distance (q value) between the shadow mask and the phosphor screen must always fall within a predetermined tolerance range.

However, in a color cathode ray tube of a shadow mask type, only ⅓ or less of the entire electron beams emitted from the electron gun reach the phosphor screen, and the other remaining beams collide onto the shadow mask. Further, the shadow mask is heated by those colliding electron beams and expands towards the phosphor screen, i.e., so-called doming occurs. The doming can be divided into two types.

One type that occurs is at the beginning of starting operation of a color cathode ray tube. Specifically, at the starting operation, the mask body of the shadow mask is mainly heated and a temperature difference occurs between the mask body and the mask frame which is provided on the peripheral edge portion of the mask body. Due to the temperature difference, doming occurs.

The other type that occurs is locally in a relatively short time when an image having a high luminance is locally displayed and the mask body is thereby locally heated and expanded.

Once doming of a shadow mask occurred, the position of the shadow mask relative to the phosphor screen changes and the q value derives from the tolerance range. Landing positions of electron beams with respect to the phosphor layers are then dislocated from predetermined positions, and as a result, the color purity of an image displayed is degraded. Landing dislocations thus caused by doming vary depending on the position of an image pattern to be displayed, the luminance thereof, and the continuation time of a high-luminance image pattern.

In addition, a landing dislocation of an electron beam caused by local doming when an image having a high luminance is displayed locally tends to easily occur at an intermediate region between the center of the shadow mask and an end of the horizontal axis thereof. This can be associated with doming of the shadow mask and the deflection angle of an electron beam. For example, even when doming occurs in the vicinity of the vertical axis of a shadow mask, the deflection angle of electron beams is small within this portion, so that the electron beam is not much affected by doming and a landing dislocation caused therefrom is small. Meanwhile, the peripheral portion of the mask body is supported on the mask frame which has a large heat capacitance by a non-aperture portion, so that heat in the mask body diffuses into the mask frame even when the peripheral portion of the mask body is locally heated. Therefore, doming which occurs in the peripheral portion of the mask body is of a low level and causes only a small landing dislocation.

In contrast, in an intermediate region between the center of the shadow mask and each end of the horizontal axis thereof, electron beams have a large deflection angle, and doming of a high level occurs when the shadow mask is locally heated within these intermediate regions. As a result, a landing dislocation tends to occur most easily at those portions of the phosphor layer which face the intermediate regions of the shadow mask.

In order to prevent a local heat expansion of a shadow mask and to prevent color blurring, the curvature of a shadow mask in its horizontal cross-section should be enlarged. In recent years, however, it has been a main trend to use a color cathode ray tube having a flattened face panel, and accordingly, such a cathode ray tube has a flattened shadow mask. Therefore, it is difficult to restrict local doming which occurs in a relatively short time and to eliminate a landing dislocation, only by means of enlarging the curvature of the shadow mask in its horizontal cross-section.

In a television set incorporating a color cathode ray tube, a landing dislocation occurs when a vibration caused by sounds or voices from a laud speaker during operation of the television set is transferred to the color cathode ray tube, the mask body itself vibrates (or causes howling) and causes a landing dislocation of electron beams, in addition to a landing dislocation caused due to doming of the shadow mask as described above. Therefore, such a landing dislocation caused by howling must be restricted.

Since the peripheral edge portion of a shadow body is fixed to a mask frame, a vibration has a small amplitude in this portion. However, in the intermediate regions of the mask body as described above, the vibration is large and a landing dislocation has the largest amount.

DISCLOSURE OF INVENTION

The present invention has been made in view of the above problem and its object is to provide a color cathode ray tube capable of reducing local doming and vibration of a shadow mask and hinders color blurring.

In order to achieve the above object, a color cathode ray tube according to the present invention comprises a face panel having a substantially rectangular effective portion which has an inner surface of a curved surface and long and short axes perpendicular to each other; a phosphor screen formed on the inner surface of the face panel and having a number of phosphor layers each having a stripe-like shape extending in a direction along the short axis; and a shadow mask opposed to the phosphor screen and having a curved shape corresponding to the inner surface of the face panel.

The shadow mask includes a substantially rectangular effective surface provided with a number of apertures for passing electron beams, having long and short axes respectively corresponding to the long and short axes of the face panel, and consisting of first and second halves which are symmetric with the short axis, and a non-aperture portion positioned around a periphery of the effective surface. The apertures are disposed so as to constitute a plurality of aperture rows extending in parallel with the short axis and disposed in a direction of the long axis, each of the aperture rows including a plurality of apertures disposed in a direction parallel to the short axis and bridges positioned between any adjacent pair of the apertures.

A width of bridges in the direction of the short axis, which are positioned at a substantially central region in each of the first and second halves is greater than a width of bridges in the direction of the short axis, which are positioned at a peripheral portion of the effective surface.

The bridges are formed so as to satisfy relations of: BMH>BH, BMH>BD, and BMH>ML, where BO is a width of the bridges in the direction of the short axis, positioned at a center O of the effective surface of the shadow mask, BV is a width of the bridges in the direction of the short axis, positioned at end portions of the short axis, BH is a width of the bridges in the direction of the short axis, positioned at end portions of the long axis, BD is a width of the bridges in the direction of the short axis, positioned at end portions of diagonal axes, BMH is a width of the bridges in the direction of the short axis, positioned at a substantially central region of each of the first and second halves, and BML is a width of the bridges in the direction of the short axis, positioned at an intermediate portion between the short axis and each of short side edges the effective surface in parallel with the short axis and at near a long side edge of the effective surface in parallel with the long axis.

A width B (x, y) of a bridge at a given coordinate position on the effective surface is formed to be a size expressed by a quaternary-exponential polynominal as follows:

$$B(x, y) = \sum_{n=0}^{2} \sum_{m=0}^{2} c(3n + m) \cdot x^{(2m)} \cdot y^{(2m)}$$

where the long axis of the effective surface of the shadow mask is an x-axis, the short axis thereof is a y-axis, and c is a coefficient.

According to a color cathode ray tube having a structure constructed as described above, the width of a bridge in the short axis direction, positioned at a substantially central portion of each of the first and second halves of the effective surface is greater than the width of bridges in the short axis direction, positioned at a peripheral portion of the effective surface. Therefore, the heat capacitance and the rigidity of the shadow mask is greater at the central portions of the first and second halves of the effective surface of the shadow mask than at the peripheral portion.

Therefore, the doming amount at the central portions of the effective surface where doming tend to occur most easily can be reduced and degradation of the color purity caused by doming can be restricted. At the same time, when the color cathode ray tube vibrates, a vibration of the central portions of the first and second halves of the effective surface can be reduced, so that degradation of the color purity caused by a vibration can be reduced.

BRIEF DESCRIPTION OF DRAWINGS

FIGS. 1 to 5 show a color cathode ray tube according to an embodiment of the present invention, in which:

FIG. 1 is a longitudinal sectional view of the color cathode ray tube,

FIG. 2 is a plan view showing the inner side of a face panel of the color cathode ray tube, FIG. 3 is a plan view showing a shadow mask of the color cathode ray tube, FIG. 4 is an enlarged plan view showing the shadow mask of the color cathode ray tube, and FIG. 5 is a cross sectional view taken along a line V—V in FIG. 4;

BEST MODE OF CARRYING OUT THE INVENTION

In the following, a color cathode ray tube according to an embodiment of the present invention will be described in details with reference to the accompanying drawings.

Figure 1:
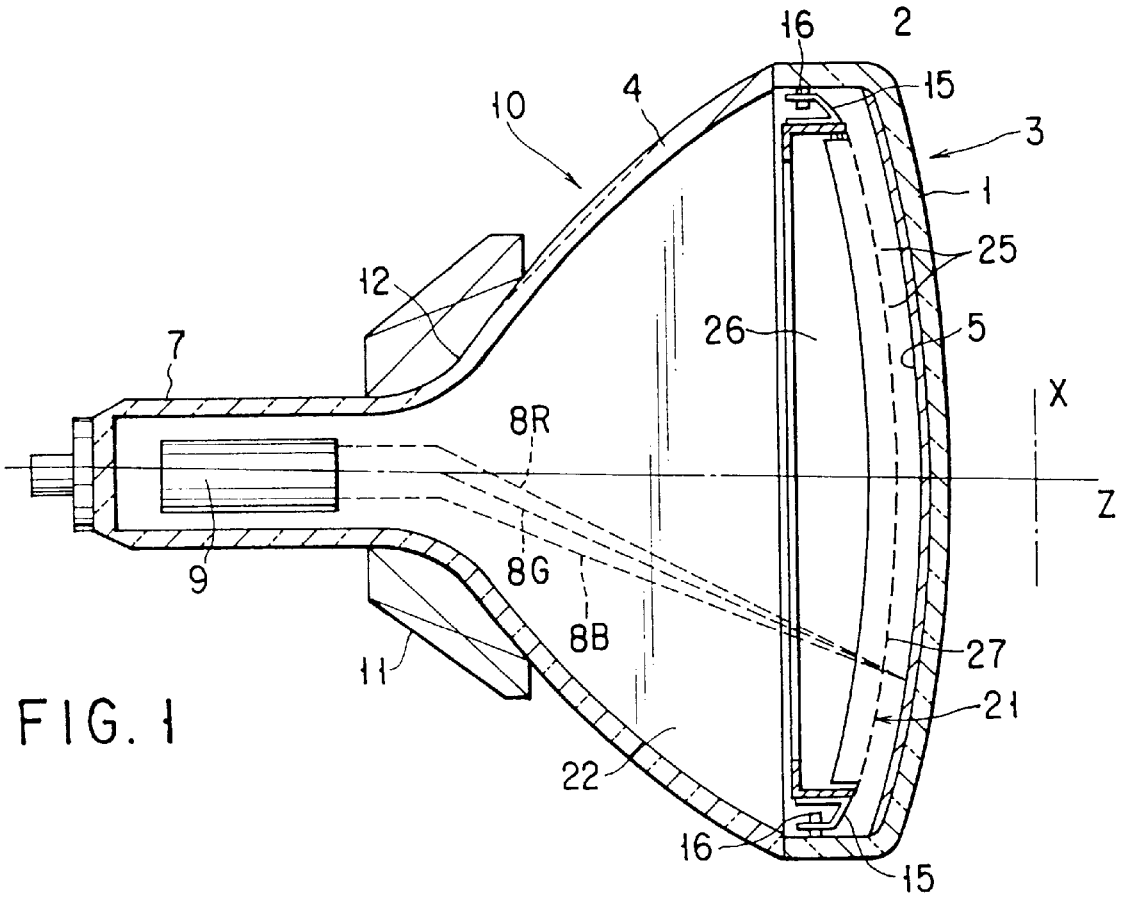
Figure 2:
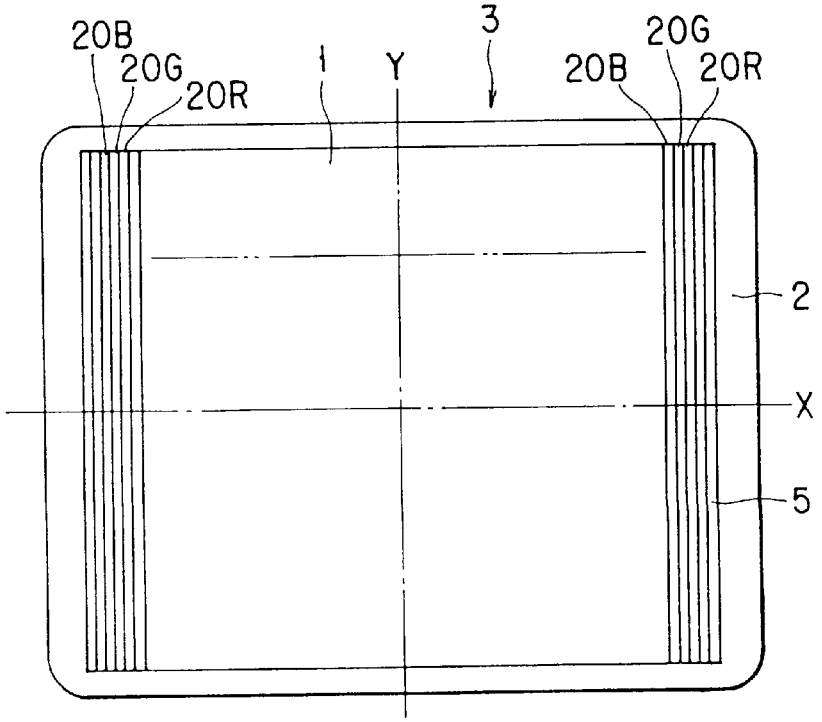

As shown in FIGS. 1 and 2, the color cathode ray tube comprises a vacuum envelope 10 made of glass. The vacuum envelope 10 includes a face panel 3 having a substantially rectangular effective portion 1 and a skirt portion 2 provided on the peripheral portion of the effective portion, a funnel 4 connected with the skirt portion 2, and a cylindrical neck 7 projecting from the funnel 4.

The effective portion 1 has a substantially rectangular shape having a horizontal axis (or long axis) X and a vertical axis (or short axis) perpendicular to each other, extending through a tube axis Z of the cathode ray tube. In addition, the inner surface of the effective portion 1 is formed of a concave curved surface which is not spherical. On the inner surface of the effective portion 1 is formed a phosphor screen 5 which includes three color phosphor layers 20B, 20G, and 20R respectively capable of radiating in blue, green, and red, and light shield layers 23 provided between the phosphor layers. The phosphor layers 20B, 20G, and 20R are formed like stripes extending in parallel with the vertical axis Y and disposed one after another in the X-axis direction.

Also, in the vacuum envelope 10, a shadow mask 21 having a substantially rectangular shape corresponding to the phosphor screen 5 is arranged to face the phosphor screen 5. The shadow mask 21 comprises a substantially rectangular mask body 27 having a number of apertures 25 and a rectangular mask frame 26 supporting the peripheral edge portion of the mask body. The shadow mask 21 is supported on the face panel 3 in a manner in which elastic support members 15 each having a substantially wedge-like shape and fixed on side walls of the mask frame 26 are engaged with stud pins 16 projecting from the inner surface of the skirt portion of the face panel 3. In this manner, the mask body 27 is opposed to the phosphor screen 5 with a predetermined distance therebetween.

An electron gun 9 for emitting three electron beams 8B, 8G, and 8R which pass in one same plane is provided in the neck 7.

In the color cathode ray tube constructed in a structure as described above the three electron beams 8B, 8G, and 8R emitted from the electron gun are deflected by horizontal and vertical magnetic fields generated by a deflection yoke 11 attached outside the funnel 4, and scan the phosphor screen 5 through the shadow mask 21, thereby displaying a color image.

Figure 3:
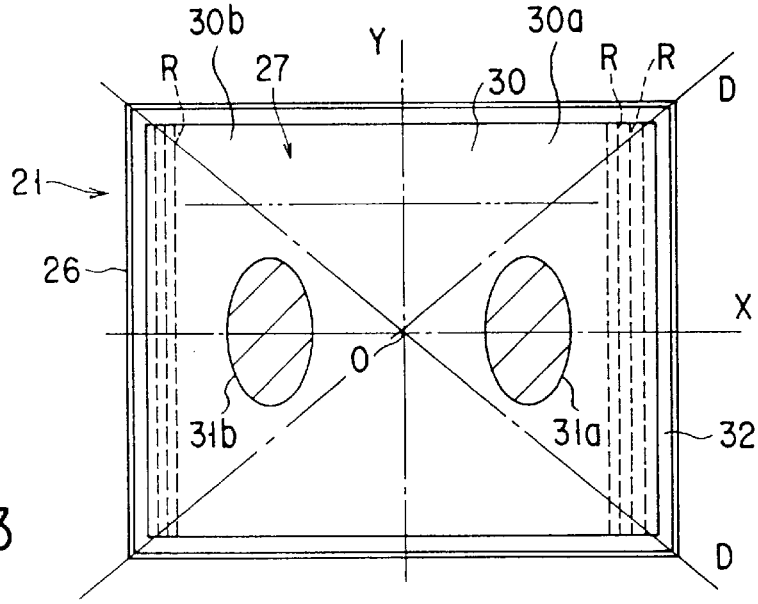
Figure 4:
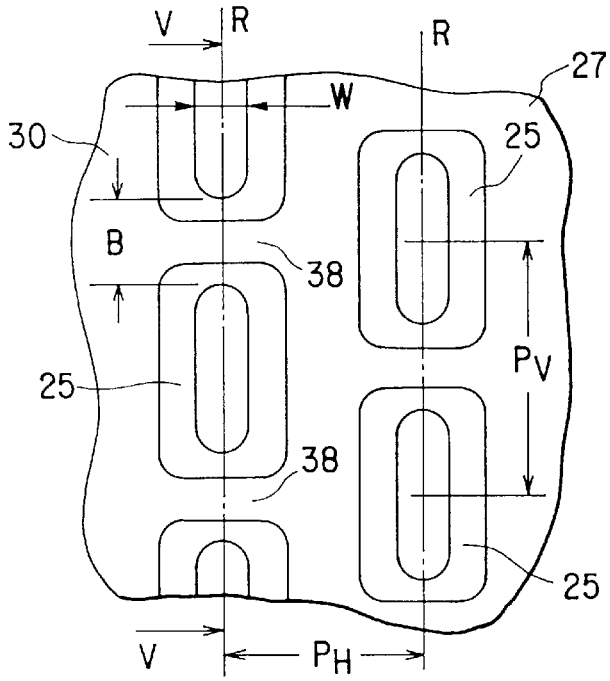

As shown in FIGS. 3 and 4, the mask body 27 is formed by processing a thin metal plate having a thickness of 0.10 to 0.30 mm, and has a substantially rectangular effective surface 30 in which a number of slit-like apertures 25 are formed for passing electron beams, and a non-aperture portion 32 positioned around the periphery of the effective surface and having no apertures. The mask body 27 has a center O where a tube axis Z passes, and a horizontal (or long) axis X and a vertical (or short) axis Y which are perpendicular to each other and passing the center O. Also, the mask body 27 is formed as a curved surface corresponding to the inner surface of the effective portion 1. The effective surface 30 consists of first and second halves 30*a* and 30*b* which are symmetric with the vertical axis Y. The non-aperture portion 32 is fixed to the mask frame 26.

A number of slit-like apertures 25 are arranged so as to constitute a plurality of aperture rows R which extend in parallel to the vertical axis Y and are disposed at a predetermined pitch PH in the direction of the horizontal axis X. Each of the aperture rows R includes a plurality of apertures 25 disposed at a predetermined pitch PV in the direction of the vertical axis Y with a bridge 38 being interposed between two adjacent apertures 25.

Figure 5:
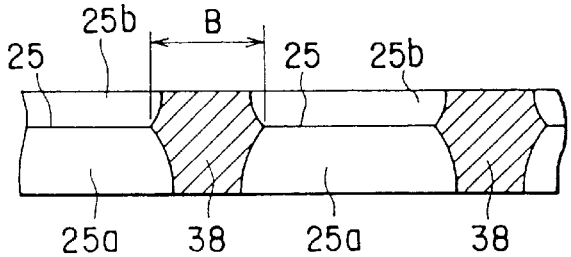

As shown in FIGS. 4 and 5, each of the apertures 25 is defined by a boundary between a large aperture 25*a* opened to the surface facing the phosphor screen 5 and a small aperture 25*b* opened to the surface facing the electron gun, in the mask body.

Figure 6:
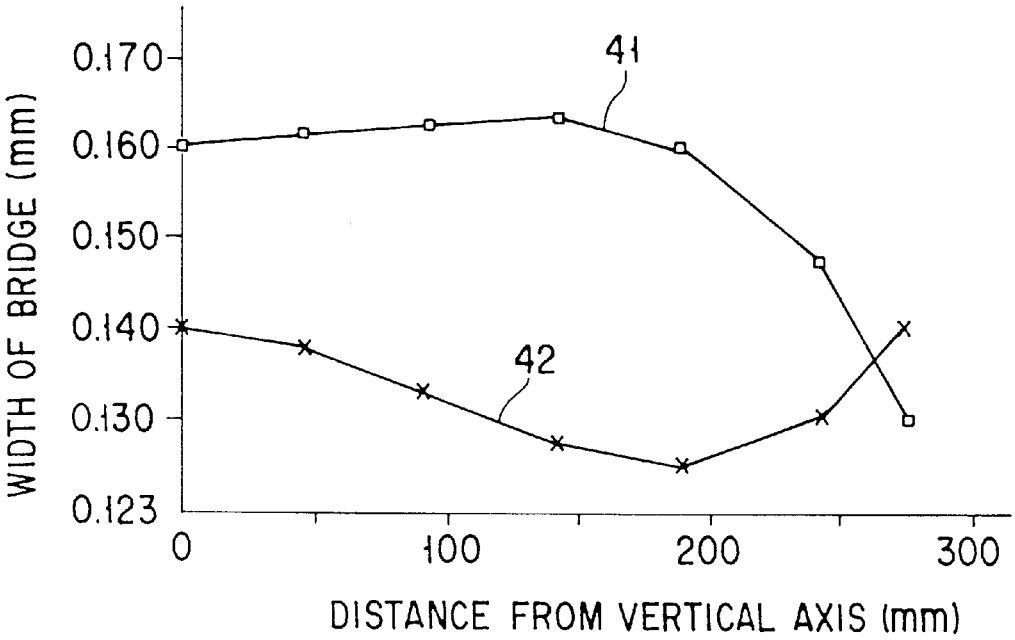
FIG. 6 is a graph showing a relationship between the width of a bridge and the distance from the vertical axis.

In the shadow mask 25 according to the present embodiment, the width B of a bridge 28 provided between two adjacent apertures 25 disposed in the direction of the vertical axis Y varies depending on its position on the mask body 27. More specifically, in FIG. 6, a curve 41 indicates a relationship between the width B of bridges near the apertures 25 disposed on the horizontal axis X of the mask body 27 and a distance to the bridge from the vertical axis Y of the mask body 27, and a curve 42 indicates a relationship between the width B of bridges disposed in the vicinity of each long side edge of the mask body 27 and a distance to the bridge from the vertical axis Y.

Figure 7:
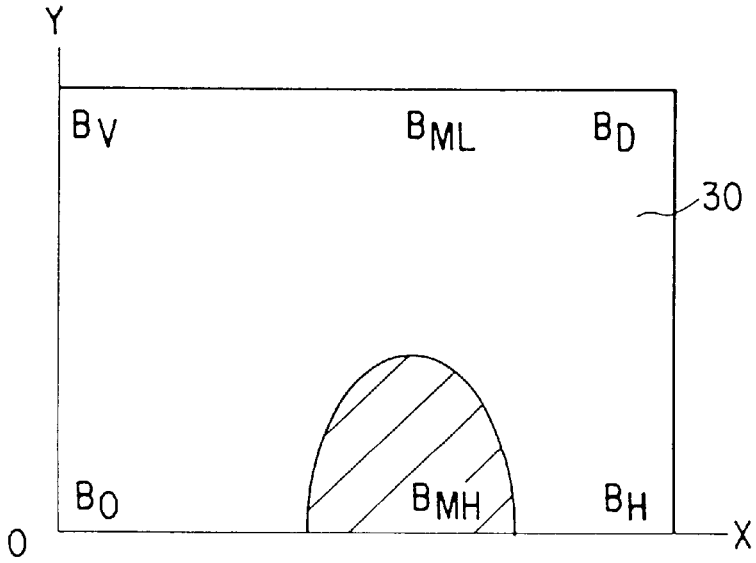
FIG. 7 is a graph showing the X-Y coordinate position of an effective area of the shadow mask.

As shown in FIG. 7, within the effective surface 30 of the mask body 27, a plurality of bridges 38 are formed so as to satisfy the following relations, where BO is the width of bridges 38 in the direction of the vertical axis Y, positioned at the center O of the effective surface 30, BV denotes the width of bridges 38 in the direction of the vertical axis Y, positioned each end portion of the vertical axis Y, BH denotes the width of bridges 38 in the direction of the vertical axis Y, positioned at each end portion of the horizontal axis X, BD is the width of bridges 38 in the direction of the vertical axis Y, positioned at each end portion of diagonal axes D, BMH denotes the width of bridges 38 in the direction of the vertical axis Y, positioned at a central region 31*a* (see FIG. 3) of each of the first and second halves 30*a*, 30*b*, i.e., at an intermediate region between the vertical axis Y and one of the short side edges of the effective surface 30 and between a pair of long side edges of the effective surface, and BML is the width of bridges 38 in the direction of the vertical axis Y, positioned at an intermediate portion between the vertical axis Y and a short side edge of the effective surface on the long side edge of the effective surface.

BMH>BH

BMH>BD and

BMH>BML

Thus, the width BMH of the bridges 38 positioned at each of the first and second central regions 31*a* and 31*b* is greater than the widths of the bridges in the other portions.

According to the shadow mask 21 constructed as described above, the pitch PV of apertures 25 disposed in the vertical direction is uniform over the entire effective surface 30, and the apertures 25 have a constant width W in the direction of the horizontal axis X. Therefore, the area of each aperture 25 decreases as the width B of the bridge 38 increases. However, if the bridges 38 positioned at the central regions 31*a* and 31*b* are formed to have a large width B, the heat capacitance at the central regions 31*a* and 31*b* of the first and second halves 30*a* and 30*b* of the mask effective surface 30 can be increased to be greater than that of another portion such as the peripheral portion of the effective surface 30.

As a result, according to the shadow mask 21 as described above, even when an electron beam having a high current density collides into the central regions 31*a*, and 31*b* on the mask effective surface 30 where doming tends to occur easily and the central regions 31*a* and 31*b* are thereby heated, a temperature increase thereby caused in these regions can be reduced since the central regions 31*a* and 31*b* have a large heat capacitance. Further, even when a heat is transferred from the central regions 31*a* and 31*b* to the peripheral portion of the effective surface 30, the area of the peripheral portion has a small heat capacitance and causes a large temperature increase, resulting in that a peak of the temperature difference between each central region and the peripheral portion of the effective surface 30 can be reduced. Accordingly, local doming of the mask body 27 which occurs with in a short time period can be reduced and a landing dislocation caused by such local doming can be reduced. As a result, degradation of the color purity caused by a landing dislocation can be reduced, so that excellent image display is realized.

The bridge width B of the shadow mask 21 can be easily realized by the following polynominal. Specifically, the width B (x, y) of a bridge in the direction of an aperture row at given coordinates (x, y) on the effective surface can be set by a quaternary-exponential polynominal relating to x and y as follows, where c is a coefficient in an x-y coordinate system defined by two perpendicular axes of the horizontal axis X and the vertical axis Y passing the center of the effective surface 30.

$$B(x, y) = \sum_{n=0}^{2} \sum_{m=0}^{2} c(3n+m) \cdot x^{(2m)} \cdot y^{(2m)}$$

The width B of a bridge 38 set by the above polynominal is, for example, arranged as follows in case of a shadow mask for a 28-inch color cathode ray tube.

The bride width BO at the center O of the mask:

BO=0.160 mm

The bridge width BMH at an intermediate portion on the horizontal axis:

BMH =0.160 mm

The bridge width BH at an end portion of the horizontal axis X:

BH=0.130 mm

The bridge width BV at an end portion of the vertical axis Y:

BV=0.140 mm

The bridge width BML at an intermediate portion on a long side edge:

BML=0.125 mm

The bridge width BD at an end portion on a diagonal axis D:

BD=0.140 mm

The coefficient c is selected as follows.

$c0=1.600000\times10^{-01}$ $c1=4.175079\times10^{-07}$ $c2=-1.181269\times10^{-11}$ $c3=-6.110379\times10^{-07}$ $c4=-6.407131\times10^{-11}$ $c5=1.082887\times10^{-15}$ $c6=-1.219065\times10^{-11}$ $c7=3.618716\times10^{-16}$ $c8=-1.471625\times10^{-21}$ Accordingly, the area of slit-like apertures 25 in the first and second central regions is smaller by 10% than that at the peripheral portion of the mask body, and the heat capacitance at the first and second central regions can be greater by a corresponding amount than that at the peripheral portion. As a result, when an image having a high luminance is displayed locally, doming can be reduced at the first and second central regions where local doming tends to occur easily. At the same time, doming caused by a temperature difference between the mask body and the mask frame provided in the peripheral portion thereof in the beginning of starting operation of a color cathode ray tube can be reduced, so that the distance (q-value) between the shadow mask and the phosphor screen can be maintained within a predetermined range. Therefore, degradation of the color purity caused by a landing dislocation of electron beams with respect to three color phosphor layers can be reduced. In particular, a remarkable advantage can be obtained in a color cathode ray tube in which the face panel is flattened and the effective surface of the shadow mask is accordingly flattened, so that projection onto the outer surface of the face panel provides an image with a natural appearance.

In addition, the width of a bridge is increased, the rigidity of the curved surface of the mask body is improved. Therefore, by setting the width of the bridges in the first and second central regions of the mask body to be larger than that in the peripheral portion of the mask body, the rigidity of the mask body can be relatively high at the first and second central regions in comparison with the peripheral portion of the mask. Accordingly, even when a vibration is applied to the color cathode ray tube by a sound or voice from a loud speaker of a television set, the amplitude of the vibration is reduced at the intermediate portion of the mask. Meanwhile, the peripheral portion of the mask effective surface is in contact with non-aperture portion or a mask frame having a high rigidity and is therefore tends to less vibrate. As a result of this, the anti-vibration characteristic is improved over the entire mask, and degradation of an image due to a vibration of a shadow mask can be reduced.

As has been described above, the area of a slit-like aperture is changed by changing the bridge width, and accordingly, the radiation area of three color phosphor layers is changed in accordance with the area of a slit-like aperture, thereby effecting the luminance of the screen. However, the effective portion of the face panel generally is thicker at a peripheral portion thereof than at a center portion thereof. In particular, a face panel of a dark tint type used for improving the contrast tends to have a low luminance at a peripheral portion of the screen. Therefore, if the bridge width is set to be large at first and second central regions of the effective surface of the shadow mask, the luminance at the peripheral portion of the screen is relatively increased and the luminance becomes uniform over the entire screen area, resulting in no problems.

What is claimed is:

1. A color cathode ray tube comprising:

a face panel including a substantially rectangular effective portion which has an inner surface of a curved surface and long and short axes perpendicular to each other;

a phosphor screen folded on the inner surface of the face panel and having a number of phosphor layers each having a stripe-like shape extending in a direction in parallel to the short axis; and a shadow mask opposed to the phosphor screen and having a curved shape corresponding to the inner surface of the face panel, the shadow mask including a substantially rectangular effective surface provided with a number of apertures for passing electron beams and having long and short axes respectively corresponding to the long and short axes of the face panel, and first and second halves which are symmetric with the short axis, and a non-aperture portion located around a periphery of the effective surface;

the apertures being disposed so as to constitute a plurality of aperture rows extending in parallel with the shots axis and disposed in a direction of the long axis, each of the aperture rows including a plurality of the apertures disposed in a direction parallel to the short axis and bridges positioned between any adjacent pair of the apertures, and a width (BMH) of the bridges in the direction of the short axis, which are positioned at a substantially central region in each of the first and second halves, being greater than a width of the bridges in the direction of the short axis, which are positioned at the peripheral portion of the effective surface, wherein the difference between the width (BMH) and a width (BML) of the bridges in the direction of the short axis, positioned at an intermediate portion between the short axis and a short side edge of the effective surface and near a long side edge of the effective surface in parallel with the long axis, being larger than the difference between the width (BMH) and a width of any other bridges in the direction of the short axis, which are positioned at the peripheral portion of the effective surface.

2. A color cathode ray tube according to claim 1, wherein the bridges are formed so as to satisfy relations of: BMH>BH, BMH>$BD_2$ BMH>BML, and BMH−BML>BMH−BH or BMH−BD, where BO is a width of the bridges in the direction of the short axis, positioned at a center O of the effective surface, BV is a width of the bridges in the direction of the short axis, positioned at each end portion of the short axis, BH is a width of the bridges in the direction of the short axis, positioned at each end portion of the long axis, BD is a width of the bridges positioned at each end portion of diagonal axes of the effective surface, BMH is a width of the bridges in the direction of the short axis, positioned at each of the central regions of the first and second halves, and BML is a width of the bridges in the direction of the short axis, positioned at an intermediate portion between the short axis and a short side edge of the effective surface and near a long side edge of the effective surface In parallel with the long axis.

3. A color cathode ray tube according to claim 1, wherein a width B (x, y) at a given coordinate position on the effective surface is formed to be a size expressed by a quaternary-exponential polynominal as follows:

$$B(x, y) = \sum_{n=0}^{2} \sum_{m=0}^{2} c(3n + m) \cdot x^{(2m)} \cdot y^{(2m)}$$

where the long axis of the effective surface of the shadow mask is an x-axis, the short axis thereof is a y-axis, and c is a coefficient.

4. A color cathode ray tube according to claim 1, wherein the plurality of apertures in each of the aperture rows are disposed at a predetermined pitch.

5. A color cathode ray tube according to claim 1, wherein each of the apertures has a slit-like shape extending in the direction of the short axis.

6. A color cathode ray tube comprising:

a face panel including a substantially rectangular effective portion which has an inner surface of a curved surface and long and short axes perpendicular to each other;

a phosphor screen folded on the inner surface of the face panel and having a number of phosphor layers each having a stripe-like shape extending in a direction in parallel to the short axis; and a shadow mask opposed to the phosphor screen and having a curved shape corresponding to the inner surface of the face panel, the shadow mask including a substantially rectangular effective surface provided with a number of apertures for passing electron beams and having long and short axes respectively corresponding to the long and short axes of the face panel, and first and second halves which are symmetric with the short axis, and a non-aperture portion located around a periphery of the effective surface;

the apertures being disposed so as to constitute a plurality of aperture rows extending in parallel with the shots axis and disposed in a direction of the long axis, each of the aperture rows including a plurality of the apertures disposed in a direction parallel to the short axis and bridges positioned between any adjacent pair of the apertures;

wherein a width B (x,y) of the bridges at a given coordinate position on the effective surface is formed to be a size expressed by a quaternary-exponential polynomial as follows:

$$B(x, y) = \sum_{n=0}^{2} \sum_{m=0}^{2} c(3n + m) \cdot x^{(2m)} \cdot y^{(2m)}$$

where the long axis of the effective surface of the shadow mask is an x-axis, the short axis thereof is a y-axis, and c is a coefficient.

* * * * *